US005806091A

United States Patent [19]

McHugh

[11] Patent Number: 5,806,091

[45] Date of Patent: Sep. 15, 1998

[54] HAND GRIP AID

[76] Inventor: Mark Lawrence McHugh, 665 Fairway Cir., Hillsborough, Calif. 94010

[21] Appl. No.: 749,085

[22] Filed: Nov. 14, 1996

Related U.S. Application Data

[63] Continuation of Ser. No. 503,300, Jul. 17, 1995, abandoned.

[51] Int. Cl.[6] ..... A41D 13/08

[52] U.S. Cl. ..... 2/20; 2/161.1; 273/26 C; 473/212; 482/49

[58] Field of Search ..... 2/16, 20, 21, 161.1; 273/75, 670 B, 26 C; 74/551.9; 473/59, 61, 201, 212; 482/49; 441/69

[56] References Cited

U.S. PATENT DOCUMENTS

| | | | |
|---|---|---|---|
| D. 387,826 | 12/1997 | Smallwood et al. | D21/198 |
| 1,479,771 | 1/1924 | Campbell . | |
| 1,607,022 | 11/1926 | Swinburne | 119/14.22 |
| 2,411,880 | 12/1946 | Jackson | 2/20 |
| 3,398,951 | 8/1968 | Disko | 473/61 |
| 3,557,776 | 1/1971 | Boots et al. | 128/897 |
| 3,606,614 | 9/1971 | Dimitroff . | |
| 4,420,843 | 12/1983 | Genzling . | |
| 4,461,043 | 7/1984 | Lomedico | 2/21 |
| 4,617,684 | 10/1986 | Green et al. . | |
| 4,748,690 | 6/1988 | Webster . | |
| 4,892,315 | 1/1990 | Iorlano | 2/20 X |
| 4,934,024 | 6/1990 | Sexton, I | 273/75 X |
| 4,977,621 | 12/1990 | Richard . | |
| 5,069,454 | 12/1991 | Frost | 2/20 X |
| 5,155,878 | 10/1992 | Dellis | 74/551.9 X |
| 5,180,165 | 1/1993 | Frost | 2/20 X |
| 5,214,799 | 6/1993 | Fabry . | |
| 5,218,719 | 6/1993 | Johnson | 2/20 X |
| 5,285,529 | 2/1994 | Arena . | |
| 5,322,286 | 6/1994 | Frost | 2/20 X |
| 5,471,682 | 12/1995 | Robins et al. | 2/161.1 |

*Primary Examiner*—Michael A. Neas

*Attorney, Agent, or Firm*—Flehr Hohbach Test Albritton & Herbert LLP

[57] ABSTRACT

A hand grip fits in the user's hand near where the palm joins the fingers and provides a support to distribute the force from a hand-held device onto the entire hand. In one embodiment, the hand grip includes an elongated resilient member that has an undulated side to accommodate the user's fingers. The member is placed adjacent to the user's fingers and superficial transverse metacarpal ligament. The member prevents the ligament, along with associated muscle and skin tissue, from being forced over the fingers when the user grasps a handle. The member can be constructed of plastic, rubber, or other material that provides flexibility and easily accommodates the user's fingers. The member may be held in place by an elastic band that is worn around a user's finger.

26 Claims, 3 Drawing Sheets

HAND GRIP AID

This is a continuation of application Ser. No. 08/503,300 filed Jul. 17, 1995, now abandoned.

FIELD

The present invention relates to a hand grip aid for use with sports equipment, exercise equipment, manual work equipment, or any other equipment that has a handle.

BACKGROUND

Hand grip aids help to prevent hand damage and discomfort when a person uses equipment that has a handle. The benefits of hand grip aids are amplified in those situations where repetitive use can cause damage or extreme discomfort including blisters and calluses. One motivation for the invention is based on experiences with sports equipment such as baseball bats, where batters are required to practice for extended periods of time while firmly gripping a baseball bat.

Many devices on the market are directed at preventing damage to a person's hand, and these devices range from thick gloves to pads that protect a person's palm. These gloves and pads serve the desire to protect the hand, but also reduce the tactile feel that is required in many sports and other activities. For example, a thick glove may protect the skin on the hand, but will reduce the ability of the user to grip a handle. As another example, a thick palm pad will reduce shock vibrations, but may cause a handle to feel overly large and reduce the ability of the user to grip the handle.

What is lacking in these devices is a mechanism to both distribute the force of the handle against the hand and comfortably accommodate the user's fingers in a way that protects the user's hands from damage while still providing good tactile feel of the handle.

SUMMARY

The present invention relates to a hand grip aid for use with sports equipment, exercise equipment, manual work equipment, or any other equipment that has a handle.

A hand grip fits in the user's hand near where the palm joins the fingers and provides a support to distribute the force from a hand-held device onto the entire hand. In one embodiment, the hand grip includes an elongated resilient member that has an undulated side to accommodate the user's fingers. The member is placed adjacent to the user's fingers and superficial transverse metacarpal ligament. The member prevents the ligament, along with associated muscle and skin tissue, from being forced over the fingers when the user grasps a handle. The member can be constructed of plastic, rubber, or other material that provides flexibility and easily accommodates the user's fingers. The member may be held in place by an elastic band that is worn around a user's finger.

Advantages of the invention include reduced hand damage and improved comfort while providing a good tactile feel and a strong grip. Another advantage of the invention is that it can be worn with a glove or without a glove and still achieve the same beneficial results or built directly into a glove or part of a glove for ease of use and convenience.

BRIEF DESCRIPTION OF THE DRAWINGS

Additional advantages of the invention will become apparent upon reading the following detailed description and upon reference to the drawings, in which.

DETAILED DESCRIPTION

The present invention relates to a hand grip for use with sports equipment, exercise equipment, manual work equipment, or any other equipment that has a handle.

Exemplary embodiments are described herein with reference to specific configurations. Those skilled in the art will appreciate that various changes and modifications can be made to the exemplary embodiments while remaining within the scope of the present invention.

Figure 1:
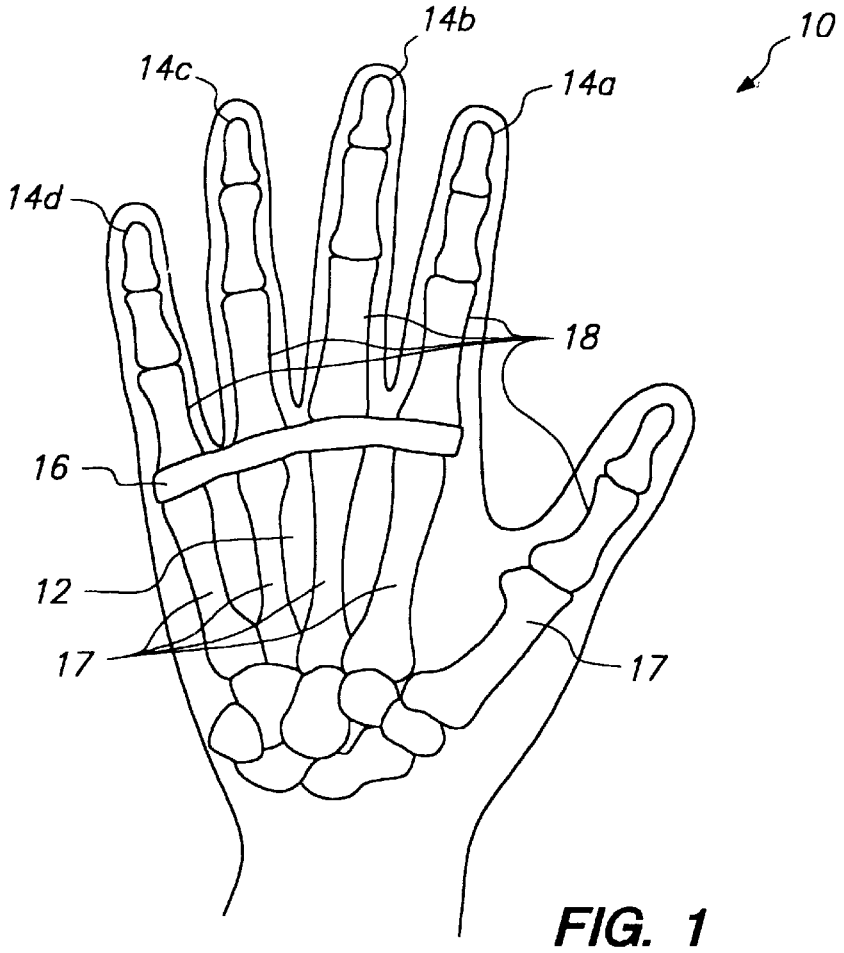
FIG. 1 is a palm view of a human hand showing the metacarpal bones, the phalanges, and the superficial transverse metacarpal ligament.

A first embodiment is described with reference to FIGS. 1–2. FIG. 1 is an illustration of a human hand 10. The hand has a palm region 12 and four fingers 14*a–d*. The hand 10 includes metacarpal bones (palm bones) 17 and the proximal phalanges (base finger bones) 18. A superficial transverse metacarpal ligament 16 serves to connect the metacarpal bones 17 near where the proximal phalanges 18 couple with the metacarpal bones 17. Ligament 16 serves to hold the metacarpal bones together and provides a base of support for the phalanges, along with cover tissue including muscle, nerves and skin. While ligament 16 and its cover material serves the valuable purpose of holding the hand together, the skin above the ligament 16 often becomes blistered or callused with repetitive use of hand-held equipment.

Figure 2A:
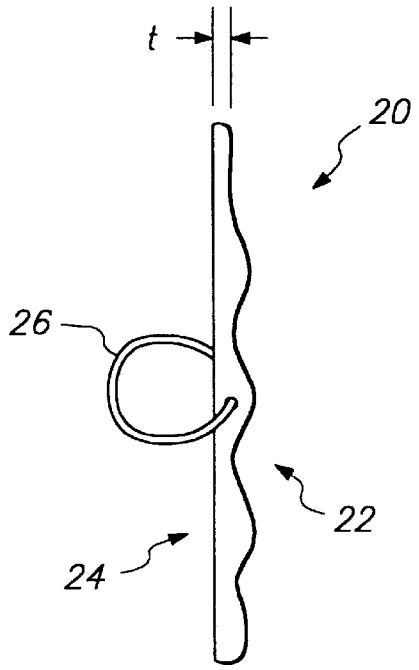
FIGS. 2A–B depict a hand grip for four fingers according to an embodiment of the invention.
Figure 2B:
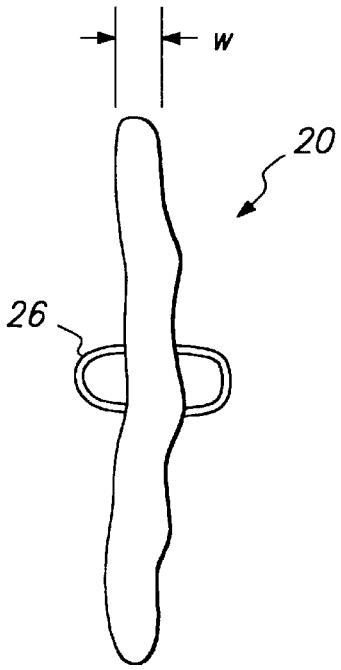

FIGS. 2A–B depict an embodiment of a grip 20 designed to fit adjacent to the ligament 16 and adjacent to the proximal phalanges 18 (the base sections of finger bones). Note that the grip 20 has one side with an undulating surface 22 and one side with a substantially planar surface 24. The undulating surface 22 is designed to accommodate the user's fingers and to fit comfortably in the user's hand 10 adjacent to ligament 16 and the base of fingers 14. In FIG. 2A, there are three undulations to accommodate the spaces between four fingers. The surface 24 is designed to contact a handle. While this embodiment shows the surface 24 as substantially planar, a semicurved surface is envisioned that may accommodate a round handle, or other shaped handle. A flexible elastic band retainer 26 is provided to attach to the user's finger so that the grip 20 will remain in the proper position. Although an elastic band is shown, any similar type retainer can be used to attach to the user, such as a velcro strap or a non-elastic strap. A T-shaped brace retainer is also envisioned where the base of the T is attached to the grip 20 and the brace fits between the middle finger and ring finger. Moreover, if desired, grip 20 can be made without band 26.

Any type of resilient material, such as plastic or rubber, can be used for the invention. The range of thickness varies due to the user's hand size and the desired feel of the handle. In one aspect of the invention, the grip 20 is be pre-molded to fit user's hand sizes from small to large, and the user can use it immediately after selecting a desired size such as one having a total length approximately equal to the width of four fingers of the user's hand. For example, the grip thickness (dimension t) can be made as thin as 1 mm to greater than 10 mm, and the grip can be made to any total length that is consistent with human hands. Also, for example, the grip width (dimension w) can be made as narrow as 4 mm to wider than 15 mm with a preferred range of 6–10 mm. In this aspect of the invention, as shown in FIGS. 2A–B, grip 20 is an elongated member that has a total length greater than three times an average thickness and greater than three times an average width.

Figure 3:
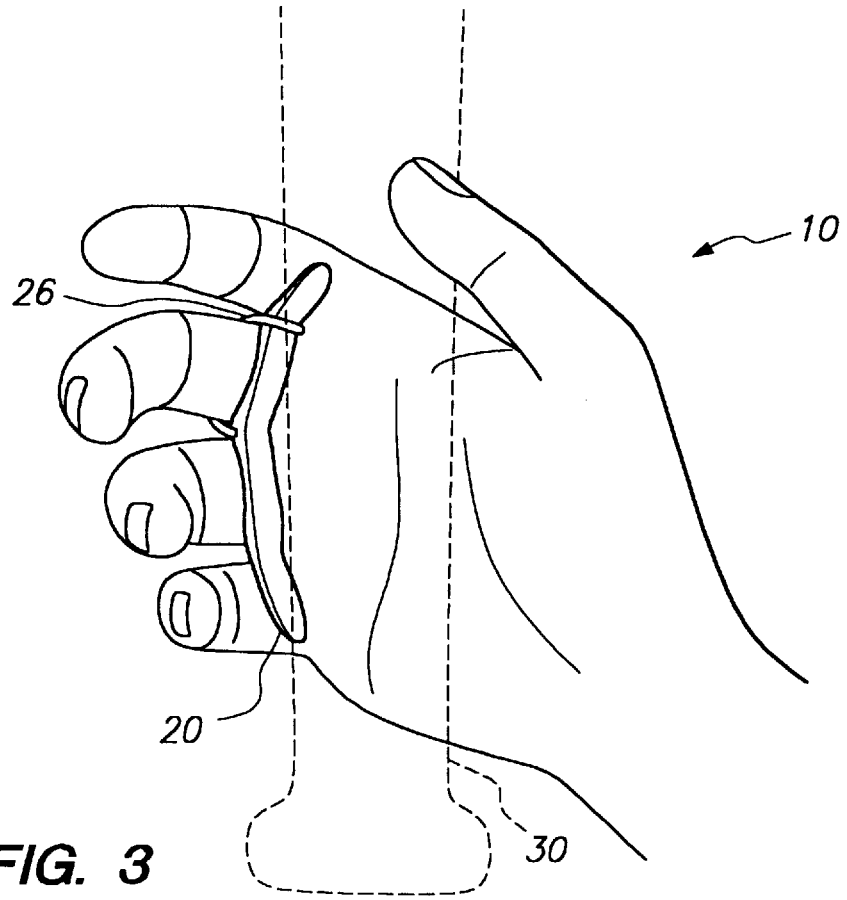
FIG. 3 depicts the hand grip of FIG. 2 being held by a user.

FIG. 3 depicts how a user positions the grip 20 in his hand. Note that the grip 20 is placed on the fingers adjacent to the ligament 18 so that when the user grabs a handle 30 (of a baseball bat) the grip 20 is positioned between the hand and the handle 30.

One reason the grip 20 is successful is that it fills an unused portion or gap, of the hand 10 where the ligament 16 and associated tissue would otherwise cause the skin to overlap over the base of the fingers 14*a–d*. As shown in FIG. 3, as the hand 10 grasps a handle 30 with the grip 20 in place, the grip 20 distributes the force of the handle 30 over the entire contact surface without an overlap of skin. Most users feel only a slight added pressure and improved comfort. Moreover, users have good tactile feel of the handle.

Tests so far conclude that a thin grip is very effective when the user wishes little or no sensation that the grip is in place, other than the relief from blisters of calluses along the skin. Moreover, the relief from pain and discomfort has been noted by users immediately after using the grip 20 even when existing blisters and calluses caused discomfort before wearing grip 20.

A thick grip 20 has some benefits over the thin grip. Not only does the thick grip relieve the pain of blisters and calluses immediately, but the thicker grip also benefits the user with a sensation of a stronger, more secure and all-around tighter grip on the device. The added pressure of grip 20 develops the region adjacent to the ligament 16 into an additional contact area. This new contact area has been noticed by a sensation of added pressure at the base of the fingers, and on the back side of the fingers, which extends to a new muscle sensation through the wrist and up the forearm. Although the grip 20 may be thick, it does not create the feeling that the handle is larger, due to the strategic placement of grip 20 in the hand 10 adjacent to the ligament 16. This benefits many users who enjoy a more secure grip when the handle is made smaller with the result that the user feels like he has more control over the equipment.

Grip 20 may be used adhered to, attached to, or not attached to the user's hand. Grip 20 may also be used with a glove, if desired. For example, grip 20 can be placed between a glove and a handle to achieve the desired placement or inside the glove closer to the user's hand if desired. Grip 20 permits the user to concentrate more on the sport or work, and less on any discomfort previously felt without grip 20. Moreover, grip 20 permits the user to gain a tighter grip on the handle so that the user can better use the equipment and still maintain a good tactile feel of the handle.

In another aspect of the embodiment, when the grip 20 is made from a plastic that is capable of being molded, the user can custom mold the grip 20. The user can place the grip 20 into a pot of boiling water for 10–15 seconds and then remove the grip 20 and place it in his hand. For this purpose the grip 20 should be made from a material having a softening point at above 40° C., preferably about 50° C. For example, a plastic type material has been used successfully to mold to user's hands without heat discomfort since the device has a softening point of approximately 50° C. This material is similar to that which is used for mouthpieces for sports such as football and boxing.

Alternatively, for custom molding, the material can be a substance that takes shape shortly after being mixed with another substance. For example, known puttytype substances that cure within minutes of mixing can be rolled into a cylinder and then pressed into the user's base finger area while gripping a handle. The resulting member will have undulations on one side and be customized for the user's hand. Putties for this purpose include those such as vinyl polysiloxane silicon rubber that is a double mix, and vinyl polysiloxane silicon rubber that is putty/reline. These substances are available from suppliers such as 3M.

Figure 4:
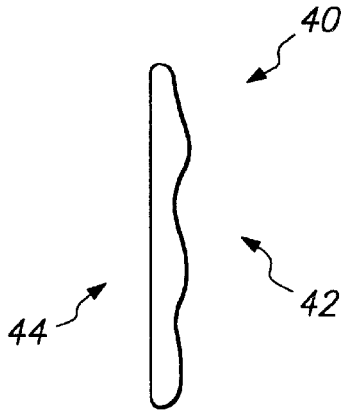
FIG. 4 depicts a hand grip for three fingers according to another embodiment of the invention.

Another embodiment is depicted in FIG. 4, where grip 40 is shorter than grip 20 shown in FIGS. 2A–B. In some cases, the user may wish a grip to fit next to one, two, or three fingers rather than four. In these cases, grip 40 is customized to fill that space by having one, two, or three undulations on one side 42. This embodiment may be useful where a handle grip area is particularly small and where only a small grip 30 can be accommodated. An example is a golf club, where only three fingers may grip the handle such as in an interlocking grip. This embodiment can also have the aspect of the prior embodiment where the grip 40 can be custom molded by heating and fitting.

Figure 5A:
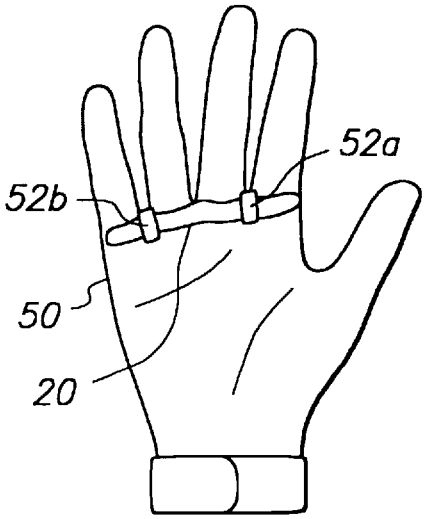
FIGS. 5A–B depict a hand grip for a glove according to another embodiment of the invention.

Another embodiment is depicted in FIG. 5A, where a glove 50 includes an attachment 52 for a hand grip 20. Glove 50 is constructed so that material is formed over the gap near the base of fingers 14. This material includes attachments 52*a* and 52*b* to hold grip 20 in place over the base of the fingers. In FIG. 5, attachments 52*a* and 52*b* are elastic straps that retain the grip 20. Alternatively, an attachment can be a single strap, a long thin pocket, or other similar retainer.

Figure 5B:
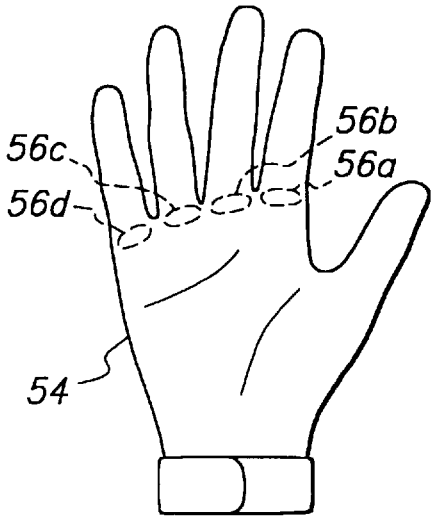

FIG. 5B shows a glove 54 where grip 20 is broken up into four small grips 56*a–d* that provide support to one finger each. This is be accomplished by incorporating four grips (as small elongated members 56*a–d*) into each of the four fingers of a glove near the base of the fingers, as shown.

Figure 6:
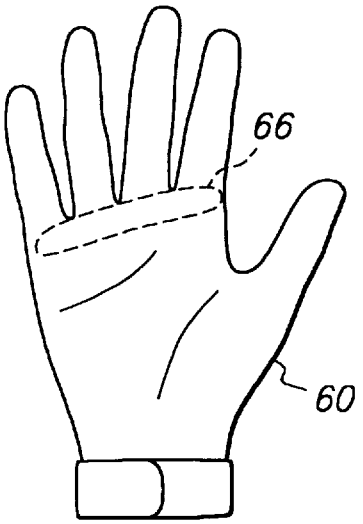
FIG. 6 depicts a palm view of an inflatable hand grip incorporated in a glove according to another embodiment of the invention.
Figure 7:
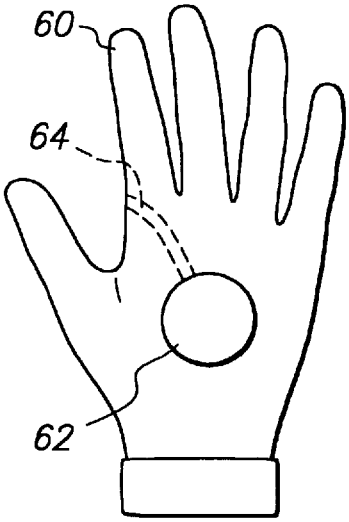
FIGS. 7 depicts the back side of the hand grip and glove of FIG. 6.

Another embodiment is depicted in FIGS. 6 and 7, where a glove 60 includes an inflatable pouch that fills the region adjacent to the users ligament 16 and the base of the fingers 14*a–d*. This embodiment includes a pump 62, a tube 64 and an inflatable member 66. A feature of this embodiment is that inflatable member 66 is positioned similar to that described above with respect to grip 20 in order to fill the unused portion of the hand where the ligament 16 and associated tissue would other wise cause the skin to overlap. Pump 62 is positioned on the back of the user's hand where the user can exert a force against the pump to inject air into the tube 64. Tube 64 delivers air to inflatable member 66 and causes member 66 to inflate to provide support to the region adjacent to the base of fingers 14. To relieve pressure in the inflatable member 66, the user squeezes the pump base to release pressure from the inflatable member 66. While the description is directed to inflating member 66 with air, any substance including gel or other fluid can be used to fill member 66.

Advantages of the invention include reduced hand damage and improved comfort while providing a good tactile feel and a strong grip. Another advantage of the invention is that it can be worn with a glove or without a glove and still achieve the same beneficial results or built directly into a glove or part of a glove for ease of use and convenience.

ALTERNATIVE EMBODIMENTS

Having disclosed exemplary embodiments and the best mode, modifications and variations may be made to the disclosed embodiments while remaining within the scope of the present invention as defined by the following claims.

What is claimed is:

1. A hand grip configured to fit in a user's hand and for use with a handled instrument, comprising:

an elongated resilient member having an average width of approximately 4–15 mm and an average thickness of approximately 1–10 mm and configured to fit at a base of the user's fingers in a gap between a palm of the user's hand and the base of the user's fingers; and a retainer connected to the member and configured to extend around to the backside of at least one of the user's fingers to retain the member in the user's hand adjacent to the base of the user's fingers.

2. A hand grip as in claim 1, wherein:

the member has a plurality of undulations designed to accommodate the user's fingers and a plurality of protuberances designed to fit between the user's fingers.

3. A hand grip as in claim 1, wherein:

the member has a plurality of undulations designed to accommodate less than four of the user's fingers and at least one protuberance designed to fit between the user's fingers.

4. A hand grip as in claim 1, wherein:

the retainer is an elastic strap configured to secure around at least one of the user's fingers.

5. A hand grip as in claim 1, wherein:

the retainer is a glove configured to secure around the user's fingers and including an attachment to retain the elongated member in a position adjacent to the base of the user's fingers.

6. A hand grip as in claim 3, wherein:

the retainer is an elastic strap configured to secure around at least one of the user's fingers.

7. A hand grip as in claim 2, wherein:

the retainer is a glove configured to secure around the user's fingers and including an attachment to retain the elongated member in a position adjacent to the base of the user's fingers.

8. A hand grip as in claim 1, wherein:

the elongated member is an inflatable member.

9. A hand grip as in claim 8, further comprising:

a pump coupled to the elongated member; and wherein the elongated member is responsive to the pump and is configured to inflate upon activation of the pump.

10. A hand grip as in claim 5, wherein:

the elongated member is an inflatable member.

11. A hand grip as in claim 10, further comprising:

a pump coupled to the elongated member; and wherein the elongated member is responsive to the pump and is configured to inflate upon activation of the pump.

12. A hand grip as in claim 1, wherein:

the elongated member includes a plurality of sub-members each configured to fit adjacent to the base of the user's fingers.

13. A hand grip as in claim 12, wherein:

the retainer is a glove configured to secure around the user's fingers and including an attachment to retain the elongated member in a position adjacent to the base of the user's fingers.

14. A hand grip as in claim 13, wherein:

the elongated member is an inflatable member.

15. A hand grip as in claim 14, further comprising:

a pump coupled to the elongated member; and wherein the elongated member is responsive to the pump and is configured to inflate upon activation of the pump.

16. An apparatus for use by a human hand to grip an object, the hand having a palm and a plurality of fingers with respective bases secured to the palm, comprising a thin elongated member made from a flexible material and having a total length greater than three times an average thickness and greater than three times an average width, the elongated member having a length sufficient to extend across the base of the fingers adjacent the palm and a plurality of longitudinally spaced-apart protuberances adapted to extend between the fingers, a curved surface extending between adjacent protuberances for forming a recess to receive the base of a finger and a retainer extending around to the backside of at least one of the fingers for removably securing the elongated member to the hand.

17. An apparatus as in claim 16 wherein the retainer for removably securing includes an elastic band having first and second ends secured to the elongated member.

18. An apparatus as in claim 16 wherein the retainer for removably securing includes a T-shaped retainer having a part thereof secured to the elongated member.

19. An apparatus as in claim 16 wherein the elongated member has a plurality of at least three longitudinally spaced-apart protuberances.

20. An apparatus as in claim 16 wherein the elongated member has an average width of approximately 4–15 mm and an average thickness of approximately 1–10 mm.

21. An apparatus as in claim 17 wherein the elongated member has an average width of approximately 4–15 mm and an average thickness of approximately 1–10 mm.

22. An apparatus as in claim 16 wherein the retainer for removably securing includes a glove including an attachment to retain the elongated member in a position adjacent to the user's fingers.

23. An apparatus as in claim 16 wherein the elongated member is an inflatable member.

24. An apparatus as in claim 23 further comprising a pump coupled to the elongated member and wherein the elongated member is responsive to the pump and is configured to inflate upon activation of the pump.

25. An apparatus as in claim 22 wherein the elongated member is an inflatable member.

26. An apparatus as in claim 25 further comprising a pump coupled to the elongated member and wherein the elongated member is responsive to tie pump and is configured to inflate upon activation of the pump.

* * * * *